United States Patent [19]

Whitten

[11] 4,222,561

[45] Sep. 16, 1980

[54] GAME DEVICE

[76] Inventor: Hubert N. Whitten, 449 Hilltop Rd., Elgin, Ill. 60120

[21] Appl. No.: 942,022

[22] Filed: Sep. 13, 1978

[51] Int. Cl.[3] ..... A63F 9/18

[52] U.S. Cl. ..... 273/1 R; 273/142 E

[58] Field of Search ..... 273/1 R, 1 E, 1 M, 272, 273/142 E, 142 F, 141 R, 138 R, 138 E, 256; 35/35 R, 35 J

[56] References Cited

U.S. PATENT DOCUMENTS

| | | | |
|---|---|---|---|
| D. 159,405 | 7/1950 | Bossart | 273/141 R X |
| 958,722 | 5/1910 | Chalmers | 273/141 R UX |
| 2,087,555 | 7/1937 | Simpson | 273/142 F |
| 2,380,106 | 7/1945 | Hilton | 273/272 X |
| 4,123,051 | 10/1978 | Tsacoyannis | 273/272 X |

FOREIGN PATENT DOCUMENTS

| | | | |
|---|---|---|---|
| 776312 | 10/1934 | France | 273/272 |

*Primary Examiner*—Paul E. Shapiro
*Attorney, Agent, or Firm*—Paul W. Grauer

[57] ABSTRACT

A game device is provided whereby a predetermined set of word category cards are selected randomly one at a time together with spinning a roulette wheel to select the first letter designation for a word response by the players which satisfies both the category and first letter so selected.

4 Claims, 3 Drawing Figures

GAME DEVICE

BACKGROUND OF THE INVENTION

This invention relates generally to game devices and more particularly to game devices which have designated two parameters calling for word responses by the players which satisfy both parameters. In this particular invention, one parameter is determined by the word category cards and the other parameter is determined by a chance means such as a roulette wheel commonly known in the art. These two parameters are both variable such that in combination the satisfactory responses of the players are virtually limitless. The game, regardless of the number of times played, would always produce unique and different responses.

Many of the game devices presently known do not provide sufficiently varying responses by the players, and, therefore, suffer the disadvantage of becoming uninteresting to the players after a period of time. The game device described herein also tests the reaction time of the palyers as well as their intellectual capacities to give the correct responses. Many present day games can only be played by individuals of approximately the same age and maturity, whereas the present game described herein, can be played by individuals of all ages at the same time since a satisfactory response by the player may be simple or sophisticated depending upon the age and maturity of the player involved.

SUMMARY OF THE INVENTION

Accordingly, it is the primary aim of the present invention to provide a game device which may be played by any number of players which is practical.

It is a further object of the present invention to provide a game device wherein the verbal responses by the players are virtually limitless.

It is another object of the present invention to provide a game device which may be satisfactorily played by players of varying ages and maturity levels.

It is also an object of the present invention to provide a game device which is simple to produce and manufacture.

It is further an object of the present invention to provide a game device which is simple to play and requires very little instruction in order to train new players.

It is finally an object of the present invention to provide a game device which may be played again and again by the same players while maintaining their interest level since the answers or word responses from the players are particularly variable.

Other objects and advantages of the invention will become apparent upon reading the following detailed description and upon reference to the drawings.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
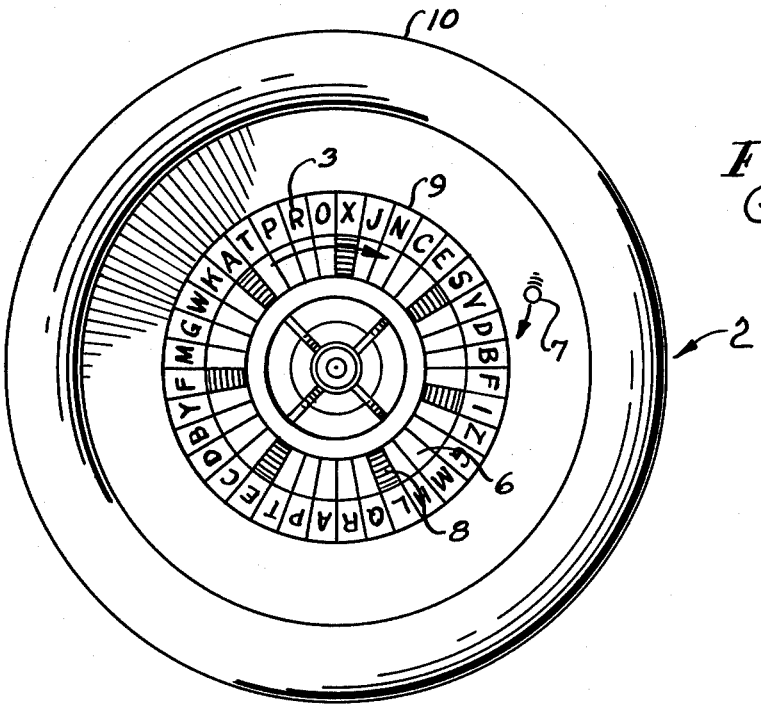
FIG. 1 is a top view of a roulette wheel device wherein the center portion rotates and the ball is shown about to enter a slot.

Referring now to FIG. 1, there is shown a chance means 2 apparatus for designating the first letter of a word which satisfies the selected word category as determined by the cards 1.

A preferred embodiment of the chance means 2 of the present invention would be a roulette-wheel type device 10 as shown in FIG. 1. The roulette-wheel type device 10 shown in FIG. 1 is a roulette-wheel commonly known in the art wherein the inner-portion 9 of the roulette-wheel 10 rotates and a ball 7 rotates in conjunction with the inner-wheel 9 and eventually the ball 7 falls into a slot 6 in the wheel 9 to designate the first letter of the word which will satisfy the word category card 1 selected at that particular time.

A preferred embodiment of the roulette-wheel type device 10 would have the letters 3 located circumferentially around the inner portion 9 of the roulette-wheel 10. Also shown in FIG. 1 are the coded slots 8 for selecting bonus markers 5 and a preferred embodiment of the invention would have the slots 6 color coded 8 such that when the ball 7 fell into a color coded slot 8 the player winning that particular point would receive a bonus clip 5 which could be attached to the card 1 which that player would receive for winning that particular competitive point.

A means for players to select at random one word category indicia 1 at a time is accomplished by a player shuffling the deck of cards 1, placing them face down and turning over one card 1 at a time. A preferred embodiment for the predetermined set of word category indicia would consist of a deck of cards 1 with the word categories 4 affixed upon one face of each card 1. The deck of cards 1 could also be color coded in the preferred embodiment wherein the color code would represent a predetermined point system as established by the game rules. After the game had been completed each player would count his cards 1 according to the predetermined point system and by that means the winner could be determined by the player with the greatest number of competitive points, including bonus points which he had received using the bonus clips 5.

Figure 2:
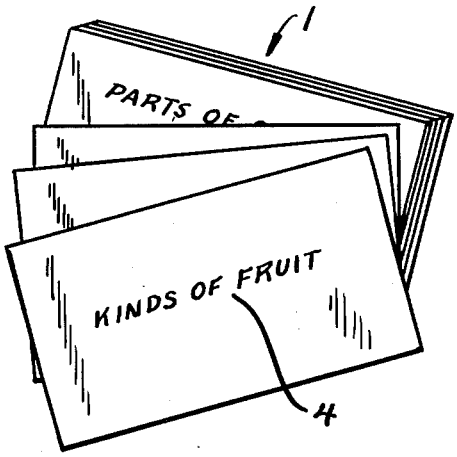
FIG. 2 is an expanded view of a deck of word category cards shwoing exemplary word categories affixed upon one face of the card.
Figure 3:
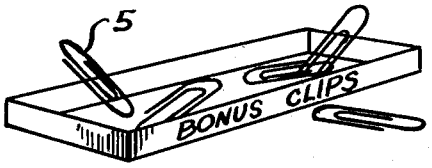
FIG. 3 is a perspective view of a box of bonus clips which are detachably mounted to the word category cards according to the game rules.

FIG. 3 shows bonus markers 5 which may be connected to work category indicia 1 and a preferred embodiment would consist of clips 5 which could be detachably mounted to the word category indicia 1 shown in FIG. 2.

Referring now to FIGS. 1, 2 and 3 and the preferred embodiment described above the game would be played as follows:

(a) Any number of players can play the game; (b) The object of the game is to have fun, think fast and to collect the largest number of points; (c) To start the game set the roulette-wheel 10 in a position where all the players can view it clearly; (d) Designate one of the players to shuffle the deck of cards 1 and then place the deck of cards 1 in a convenient position face down; (e) Designate one player who is responsible for turning over the category cards 1, one at a time; (f) Designate one player to spin the roulette-wheel 10; (g) To commence the game a card 1 is turned over by the player and placed face up so that all the players can view the card and the player turning over the card 1 reads the word category 4 on the face of the card 1 allowed to all of the players; (h) A player spins the inner-portion 9 of the roulette-wheel type device 10 so that the ball 7 spins about the device and eventually falls into a slot 6 which designates a letter 3; (i) At this point in time the players have a word category 4 before them and a letter 3 designated by the roulette-wheel 10.

The first player to name an example of the word category 4 beginning with the letter 3 designated by the roulette-wheel 10 wins the category card 1 which has been turned over. As an example, the card 1 "Kinds of Fruit" may be turned over. The roulette-wheel 10 designates the letter 3 "R" as the first letter of word which satisfies the selected word category. One of the players responds "Raspberry" before any other player responds. The word category card 1 designated "Kinds of Fruit" would then be taken by the player who had called out "Raspberry" and the game would continue.

In the preferred embodiment the deck of cards 1 could be color coded such that orange cards would be 1 point, green cards would be 2 points, and yellow cards would be 3 points. Also, in the preferred embodiment the slots 6 in the roulette-wheel 10 could be color coded 8 such that if the ball 7 fell into a color coded slot 8 a player winning that word category card 1 would attach a bonus marker or clip 5 to the word category card 1 and that particular player would receive double points for that particular card 1. The bonus clips 5 are shown in the configuration of a paper clip form which can be readily detachably mounted to the cards 1.

The rules of the preferred game would be as follows: (1) Any response from a player may be confirmed by at least one other player in the game and a dictionary or atlas or other supporting books may be used to confirm a correct response. (2) If no player is able to make a response within one minute from the time a card 1 is turned over, the card should be bypassed and another card 1 selected. (3) If two or more players appear to respond at the same time, a majority of the other players will decide which player wins the card 1 if any.

While a preferred embodiment, procedure and rules are set forth above, it is understood that the invention may comprise other alternatives, modifications and equivalents.

I claim:

1. A game device, which comprises: a predetermined set of word category indicia; means for players to select at random one word category indicia at a time; a chance means apparatus for designating the first letter of a word which satisfies the selected word category, and bonus markers selected by said chance means which thereafter may be connected to the word category indicia to represent bonus points for players, whereby any player of the game may, after selection of a word category and designation of a first letter, win competitive points by signaling a responsive word which satisfies the category indicated and begins with the letter designated.

2. A game device, as recited in claim 1, wherein the bonus markers comprise clips which are detachably mounted to the word category indicia.

3. A game device, as recited in claim 1, wherein the chance means apparatus for designating the first letter of a word comprises a roulette-wheel type device with coded slots for selecting said bonus markers.

4. a game device, as recited in claim 3, wherein said coded slots comprise color coded slots.

* * * * *